US006406006B1

(12) United States Patent
Dettling et al.

(10) Patent No.: US 6,406,006 B1
(45) Date of Patent: Jun. 18, 2002

(54) AUTOMATED HUMIDIFICATION SYSTEMS AND METHODS FOR THEIR USE

(75) Inventors: Charlie R. Dettling, Sparks, NV (US); James Coyle, Milwaukie; Spencer Croydon, Portland, both of OR (US)

(73) Assignee: Raytec Corporation, Lake Oswego, OR (US)

( * ) Notice: Subject to any disclaimer, the term of this patent is extended or adjusted under 35 U.S.C. 154(b) by 0 days.

(21) Appl. No.: 09/534,489

(22) Filed: Mar. 24, 2000

Related U.S. Application Data

(60) Provisional application No. 60/125,956, filed on Mar. 24, 1999, now abandoned.

(51) Int. Cl.[7] ..... B01F 3/04

(52) U.S. Cl. ..... 261/128; 261/28; 261/69.1; 261/78.2; 261/115; 261/131; 261/DIG. 14

(58) Field of Search ..... 261/28, 35, 69.1, 261/115, 78.2, 128, 129, 130, 131, 137, 138, 139, 142, DIG. 14, DIG. 53

(56) References Cited

U.S. PATENT DOCUMENTS

| | | | | |
|---|---|---|---|---|
| 1,908,968 A | | 5/1933 | Forman | |
| 3,304,011 A | | 2/1967 | Paasche | 239/305 |
| 4,572,428 A | * | 2/1986 | Groff et al. | 236/44 A |
| 4,808,303 A | | 2/1989 | Edwards et al. | 210/138 |
| 4,828,182 A | * | 5/1989 | Haruch | 239/432 |
| RE33,067 E | | 9/1989 | Corrigan | 62/231 |
| 5,193,354 A | | 3/1993 | Kleinberger et al. | 62/247 |
| 5,350,117 A | * | 9/1994 | Kleinberger et al. | 261/78.2 |
| 5,470,970 A | | 11/1995 | Sager et al. | 536/23.5 |
| 5,651,502 A | | 7/1997 | Edwards | 239/450 |
| 5,765,752 A | * | 6/1998 | Herr et al. | 239/117 |
| 5,771,789 A | * | 6/1998 | Davis | 99/468 |
| 5,806,762 A | * | 9/1998 | Herr et al. | 236/44 A |

FOREIGN PATENT DOCUMENTS

| | | |
|---|---|---|
| GB | 2258299 | 3/1993 |

* cited by examiner

*Primary Examiner*—C. Scott Bushey
(74) *Attorney, Agent, or Firm*—Ann W. Speckman; James E. Klaniecki

(57) ABSTRACT

Improved systems and methods for the hydration of environments such as display cases, walk-in storage rooms, greenhouses and large-scale storage facilities are provided. Consistent humidification is provided while effectively eliminating the problem of water streaming from atomization nozzles at the end of a pressurization and atomization cycle. The present invention eliminates the traditional regulators, pressure tanks and solenoid valve assemblies required to control water pressure, as well as bladder tanks and regulator valves for regulating air pressure, while more effectively controlling the problem of streaming by incorporating a drawback valve and, optionally, a miniature water regulator. Kits for retrofitting existing humidification systems to incorporate the improvements described herein are also provided.

14 Claims, 2 Drawing Sheets

AUTOMATED HUMIDIFICATION SYSTEMS AND METHODS FOR THEIR USE

This application claims domestic priority under 35 U.S.C. 119(e) to U.S. provisional application No. 60/125/956, filed Mar. 24, 1999, now abandoned.

FIELD OF THE INVENTION

The present invention relates to systems and methods for extending the life of fresh and/or perishable food products using automated humidification systems. The invention relates particularly to the use of automated humidification systems that release water vapor or droplets into various environments for storage of fresh or perishable products.

BACKGROUND OF THE INVENTION

To maintain the freshness and desirable appearance of fresh products, such as perishable foods displayed in a merchandising case or display counter in a supermarket, or produce or plant materials housed in a storage facility, the produce must be kept in an environment that is cool and moist. The amount of moisture must be carefully regulated to maintain the quality and storage-life of various perishable products. For example, dehydration of fresh produce results in spoilage, an unattractive product appearance and reduced salability. Too much moisture may result in excess water retention, producing an undesirable appearance and increased susceptibility of the products to bacterial or fungal growth.

Several systems have been developed for hydrating fresh food items. Automated fresh produce hydration systems are described, for example, in the following U.S. Patents, which are incorporated herein by reference in their entireties: U.S. Pat. Nos. 4,808,303; 5,470,970; and 5,651,502. These patents describe various approaches to hydrating fresh food. In all of them, water is conveyed to a plurality of spray or nozzle heads designed to deliver moisture in the form of a mist or a fog or vapor to food items displayed or stored below the spray heads. These systems utilize a regulator, solenoid valve and pressurization tank to adjust and maintain the water pressure.

Many conventional humidification systems utilize air pressure to atomize water, forming a vapor which is then distributed into the environment to regulate the relative humidity. To atomize water, conventional systems employ air pressure in combination with pressurized water to generate a pressure head sufficient to force the air/water mixture through the spray head or nozzle assembly to achieve a very fine water vapor. The water pressure determines the volume of water dispersed into the environment through the spray heads. The interval and duration of water vapor release is regulated through a timer, sensor or control device that activates a compressor, which pressurizes the system as described above.

An inherent problem with humidification and misting systems is the "streaming" of water from the spray heads or nozzles at the end of a pressurization and water atomization cycle, which is due to residual pressure in the water line. This streaming of water is very undesirable because excess water adversely affects the quality and storage life of the products immediately below. To compound the problem, the greater the water pressure of the system, as required for a large storage facility, the greater the streaming effect. To remedy this problem, conventional systems reduce the water pressure down to a range of 2 to 5 psi by means of a regulator and solenoid valve system at the end of a pressurization cycle. Additionally or alternatively, these systems often require a bladder tank on the air line to serve as a capture reservoir for surplus air pressure once the compressor has shut off at the end of a cycle. By reducing the water and/or air pressure, the system pressure drops accordingly, alleviating the force that causes the water to release or stream from the spray heads.

Furthermore, to achieve proper atomization of water, conventional systems require a carefully balanced ratio of air to water pressure, which must be tailored to the specific application. For example, a seafood display case in a supermarket requires low air and water pressure to deliver a small volume of water vapor and maintain a predetermined relative humidity, whereas a large produce storage facility requires higher air and water pressure to deliver a large volume of water and maintain a desired relative humidity. In all instances, the volume of water vapor required to achieve the desired relative humidity for each particular application requires a careful balancing of the air to water pressure ratio. This individualized "tuning" of the system is required to meet the specific requirements of the particular environment in which the humidification system is employed. These systems have many disadvantages.

Another deficiency of conventional humidification and misting systems, specifically systems employed in large storage facilities, is blockage of the misting nozzles, water and air lines due to freezing. In general, the majority of the systems installed in storage facilities are for cold storage, which typically require ambient air temperatures of 34° F. To achieve and sustain a uniform 34° F. ambient temperature, it is common for the nozzle assemblies and the air and water lines to be exposed to temperatures ranging from 20–25° F. due to their proximity to refrigeration systems. As a result, water freezes in atomization nozzles and water lines, as well as water accumulated in air lines through condensation. The present invention remedies this problem by providing a system incorporating a heated conduit assembly. The heated conduit assembly is incorporated into humidification systems immediately upstream of the atomization nozzles and maintains the temperature of the atomization nozzles and associated air and water lines above the freezing point to prevent blockage of the system.

The present invention is therefore directed to an automated humidification system that is more effective and efficient, less expensive to manufacture and install, and more flexible in its application than automated humidification systems currently used by industry. These features will be further discussed herein and represent a significant advance in this field.

SUMMARY OF THE INVENTION

The present invention provides improved systems and methods for the hydration of environments in which perishable products are displayed and/or stored. Systems of the present invention are especially suitable for use in connection with the storage and display of fresh and/or perishable food items, including fresh fruits and vegetables, meat, seafood, dairy, tobacco and floral items. Notably, the inventive systems may be employed in various storage environments such as display cases, walk-in storage rooms, greenhouses and large-scale storage facilities, or other such environments.

A particular aspect of the present invention is directed towards systems, methods and kits for providing consistent humidification while effectively eliminating the problem of "streaming." Streaming or dripping, as used herein, is defined as water escaping from atomization nozzles at the end of a pressurization and atomization cycle. Streaming is effectively controlled by one or more drawback valves incorporated into automated humidification systems. At the end of a pressurization and atomization cycle, said drawback valve generates negative water pressure in associated water lines and components, thereby drawing the water head in a retrograde direction and holding said water head in place until the next pressurization cycle. Negative water pressure generated by drawback valve effectively prevents water streaming from atomization nozzle assemblies. Furthermore, residual air pressure in associated air distribution lines fully atomizes any residual water in associated water lines and components, thereby displacing any residual water that may be inclined to stream onto products below.

The present invention provides a more compact and self-contained system that utilizes fewer parts, and therefore is less expensive to manufacture. The present invention eliminates the traditional regulators, pressure tanks and solenoid valve assemblies required to control water-pressure, as well as bladder tanks and regulator valves for regulating air pressure, while more effectively controlling the problem of streaming.

Systems of the present invention are simpler and less expensive to install, operate and maintain. In conventional systems, the water regulator is much larger and installed in a location away from the nozzle heads, whereas the present invention may optionally utilize a miniature water regulator located in proximity to the nozzle assembly. As mentioned above, the present invention eliminates the traditional water regulators, pressure tanks and solenoid valve assemblies, and air bladder tanks and air regulator valves, as well as the electrical connections required to install them.

Embodiments of the present invention are more versatile by utilizing a standard atomization nozzle assembly which may be used for a wide variety of applications. This greatly simplifies and lowers the cost of installation by eliminating the necessity of determining the correct nozzle assembly for each particular application. Additionally, a variety of nozzle assemblies may be used in connection with the present invention to achieve an even wider range of applications.

The present invention reduces the time required to disperse atomized water into the atmosphere. In contrast to conventional systems, the present invention requires a only a small drop in air pressure sufficient to activate the drawback feature of the drawback valve, which holds the water head inches from the atomization nozzle. Upon activation of a pressurization and atomization cycle, the system is poised to disperse the atomized water immediately.

The humidification systems of the present invention, incorporating a drawback valve and, optionally, a miniature water regulator eliminates manually balancing the air to water pressure ratio for each particular application, as currently required in conventional systems. Drawback valves incorporated into humidification systems of the present invention, having an air pilot 2-way poppet design, automatically maintains a pressure differential of 10–12 psi air pressure over water pressure. As the water pressure varies, the drawback valve adjusts accordingly to maintain the necessary air pressure for proper atomization of water at the nozzle assembly. The present invention thereby eliminates the need to manually adjust the air pressure to maintain proper atomization.

Embodiments of the present invention are capable of operating at very high water pressure conditions without the use of traditional water regulators, solenoid valves and pressure tanks. The present invention incorporating a drawback valve, and optionally, a miniature water regulator, is capable of operating at water pressures greater than or equal to 80–100 psi, resulting in a greater volume of water vapor released into the atmosphere. Furthermore, because the present invention incorporating a drawback valve, and optionally, a miniature water regulator, is capable of operating at higher water pressures, the inventive systems generate a finer mist or water vapor, i.e. water droplets having a relatively small median diameter, without the additional air and water components described above. Consequently, the fine water vapor or mist circulates in the atmosphere longer and is less prone to precipitate onto items being stored. These attributes are especially important in large applications, such as in walk-in coolers and in particular, large storage facilities, where the tremendous volume of air in the enclosed facility requires more water vapor to maintain a suitable relative humidity and temperature. Notably, even at these higher pressures, the current invention prevents streaming from atomization nozzle heads.

Embodiments of the present invention prevent blockage of the humidification system due to freezing water in the atomization nozzle assemblies and adjoining air and water lines. These components are typically installed in close association with refrigeration works to cool the water vapor in order to maintain a cold environment. The present invention provides a system incorporating a heated conduit assembly. The heated conduit assembly is incorporated into humidification systems immediately upstream of the atomization nozzles and maintains the temperature of the atomization nozzles, air and water lines above freezing to prevent blockage of the system.

Automated humidification systems of the present invention include one or more drawback valves, miniature water regulators and/or heated conduit assemblies operably connected through various distribution lines, electrical connections and communication links to compressed air and pressurized water sources, systems controls and atomization assemblies.

According to one preferred embodiment of the present invention, an automated humidification system comprises a drawback valve and miniature water regulator operably connected through various distribution lines, electrical connections and communication links to compressed air and pressurized water sources, systems controls and atomization assemblies. Such preferred embodiments may preferably be used in display cases, small storage facilities and ripening rooms.

According to another preferred embodiment of the present invention, an automated humidification system comprises a drawback valve and a heated conduit assembly operably connected through various distribution lines, electrical connections and communication links to compressed air and pressurized water sources, systems controls and atomization assemblies. Optionally, in yet another embodiment, the humidification system may additionally comprise a miniature water regulator. Such embodiments may preferably be used in storage facilities of all sizes.

The present invention also provides kits for retrofitting existing humidification systems for the hydration of environments in which perishable products are displayed and/or stored. Kits of the present invention comprise one or more drawback valve(s), miniature water regulator(s) and/or heated conduit assembly(ies), as well as any accessory components required for efficient installation, such as, but not limited to atomization nozzle assemblies, air and water lines, conduits, fittings, connectors, electrical connectors, and the like. Several of the aforementioned components may be pre-assembled, or alternatively, provided as individual components.

DETAILED DESCRIPTION OF THE INVENTION

Figure 1:
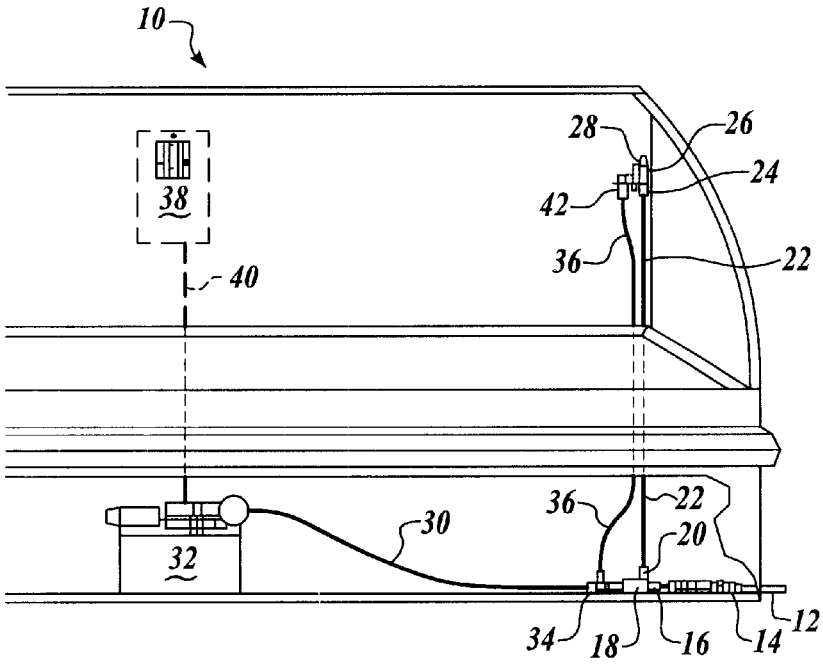
FIG. 1 is an illustrative diagram of a typical display case integrating the drawback valve, miniature water regulator and nozzle assembly components.

The present invention provides an improved system and methods for the hydration of environments in which perishable products are displayed and/or stored. The inventive system may be employed in various storage environments such as display cases, walk-in storage rooms, greenhouses and large-scale storage facilities, or other such environments. The system of the present invention is especially suitable for use in connection with the storage and display of fresh and/or perishable food items, including fresh fruits and vegetables, meat, seafood, dairy, tobacco and floral items.

While the invention may be susceptible to embodiment in different forms, the specific embodiments in the drawings and described in detail herein, are presented with the understanding that the present disclosure is to be considered an exemplification of the principles of the invention, and is not intended to limit the invention to that as illustrated and described herein.

FIG. 1 illustrates a cut-away view of a representative display case 10 for the storage and display of fresh and/or perishable food items that incorporates the humidification system of the present invention. The particular embodiment presented in FIG. 1 is purely illustrative. One of skill in the art will readily appreciate that many modifications and variations in the details may be made, such as including conventional manifold assemblies for distributing a plurality of atomization components and sensor connected to controller, and the like. The accompanying figures serve to highlight the advances provided by the present invention. It is understood that the inventive system(s) may be used in applications other than display and storage cases, such as, but not limited to, greenhouses, floral rooms, storage rooms and facilities, ripening facilities and the like.

Figure 3:
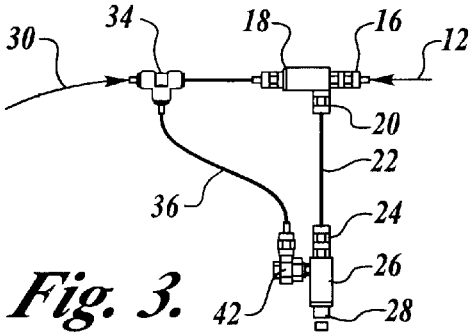
FIG. 3 is a generalized configuration of a drawback valve, miniature water regulator, atomization nozzle assembly and associated components.

A water supply line 12 connected by any conventional means to an optional valve means 14, such as a ball valve assembly, or other comparable valve assembly is connected in-line to a water inlet 16 of a drawback valve 18. Drawback valve 18 is a preferably 2-way poppet with an air pilot that is normally closed in the resting position. The present invention envisages incorporating various forms of drawback valves having different configurations and pressure ratings, but in preferred embodiments, drawback valve 18 is provided by Clippard Minimatic (Cincinnati, Ohio), part number WDV-2P. A water distribution line 22, as more clearly shown in FIG. 3, is connected by any suitable connecting means to a water outlet of drawback valve 18 and terminates at a water inlet connection 24 of a miniature water regulator 26. Miniature water regulator 26 is preferably an adjustable pressure, self-relieving, piston-type regulator. Various miniature water regulator may be employed in the present invention, but especially preferred embodiments utilize miniature water regulator MAR-1P provided by Clippard Minimatic (Cincinnati, Ohio). Connected to the terminal end of miniature water regulator 26 is a standard atomization nozzle assembly 28. The present invention may employ a variety of atomization nozzle assemblies, such as, but not limited to series 1050 and/or 2050 nozzle fluid assemblies used with air cap assemblies 64, 67 and/or 70 in any combination, but in preferred embodiments, atomization nozzle assembly 28 is part number 1650/64 manufactured by Spraying Systems (Wheaton, Ill.).

As defined herein, atomization refers to the mixture of pressurized water and compressed air to form water droplets, mist, vapor, fog and the like. The term "atomization" is not meant to limit the size or volume of the water droplets. The present invention envisages providing a wide range of water droplet sizes to accommodate various applications.

An air supply line 30 is connected to a compressed air supply 32, such as any conventional compressor. Compressed air supply 32 is controlled by any suitable automated controller system 38, having an electrical communication connection 40 to compressed air supply 32. Automated controller systems are well known in the art and any appropriate controller system may be used in the present invention. The system 10 may have an optional sensing means in communication with automated controller system 38 to regulate relative humidity and other parameters. Air supply line 30 terminates at a multi-port connecting means 34, wherein compressed air is provided to drawback valve 18 and to an air distribution line 36, which terminates at miniature water regulator 26 through a conventional connecting means 42.

Operationally, system controller 38 actuates compressed air supply 32 through electrical communication connection 40, whereby pressurized air is provided to miniature water regulator 26 via air supply line 30, multi-port connecting means 34 and air distribution line 36. Air distribution line 36 thereby provides pressurized air to atomization nozzle assembly 28 through miniature water regulator 26. In addition, pressurized air is provided to drawback valve 18 through air supply line 30 and multi-port connecting means 34.

Drawback valve 18 is controlled by air pressure, which in turn regulates the flow of pressurized water to atomization nozzle assembly 28. Air pressure within drawback valve 18 increases to a predetermined threshold level causing an internal piston to be displaced. The displaced piston opens water inlet port 16, allowing pressurized water to flow from water supply line 12 through valve means 14 to water inlet port 16 of drawback valve 18 Pressurized water flows through drawback valve 18 to water outlet 20 of drawback valve 18 to water distribution line 22, which, in turn, provides pressurized water to miniature water regulator 26. Miniature water regulator 26 has an adjustably restrictive means to adjust the water pressure and water flow to atomization nozzle assembly 28. Incorporating a miniature water regulator proximal to the atomization nozzle assembly, in conjunction with a drawback valve, eliminates the larger and more expensive water regulator and solenoid valves assemblies for regulating water pressure, as well as bladder tanks and regulator valves for controlling air pressure found in conventional humidification systems.

Compressed air and pressurized water are combined at the atomization assembly 28 and released into the atmosphere as a fine water vapor. The atomization of water by the mixture of air and water may be external or internal of the nozzle assembly, depending on the type of assembly used. The size of the water droplets released into the atmosphere may be adjusted by selecting appropriate atomization nozzle assemblies. Humidification systems of the present invention may accept a wide variety of atomization nozzle assemblies, such as, but not limited to series 1050 and/or 2050 nozzle fluid assemblies used with air cap assemblies 64, 67 and 70 in any combination, but in preferred embodiments, atomization nozzle assembly 28 is part number 1650/64 manufactured by Spraying Systems (Wheaton, Ill.).

At the end of the pressurization and atomization cycle, system controller 38 sends a signal via communication connection 40 shutting off compressed air supply 32, thereby reducing air pressure to drawback valve 18 causing drawback valve'internal piston to return to its original position, closing water inlet port 16. Displacement of the internal piston of drawback valve 18 to its original position generates negative water pressure in drawback valve 18 and water distribution line 22. The negative water pressure exerted by drawback valve 18 through water distribution line 22 and miniature water regulator 26 draws the water head in a retrograde direction back into water distribution 22 line several inches and holds the water head in place until the next pressurization cycle.

Negative water pressure generated by drawback valve 18 effectively prevents water from streaming from atomization nozzle assembly 28. Furthermore, residual air pressure in air distribution line 36 fully atomizes any residual water in miniature water regulator 26 and atomization nozzle assembly 28, thereby displacing any water that may stream or drip onto products below.

Figure 2:
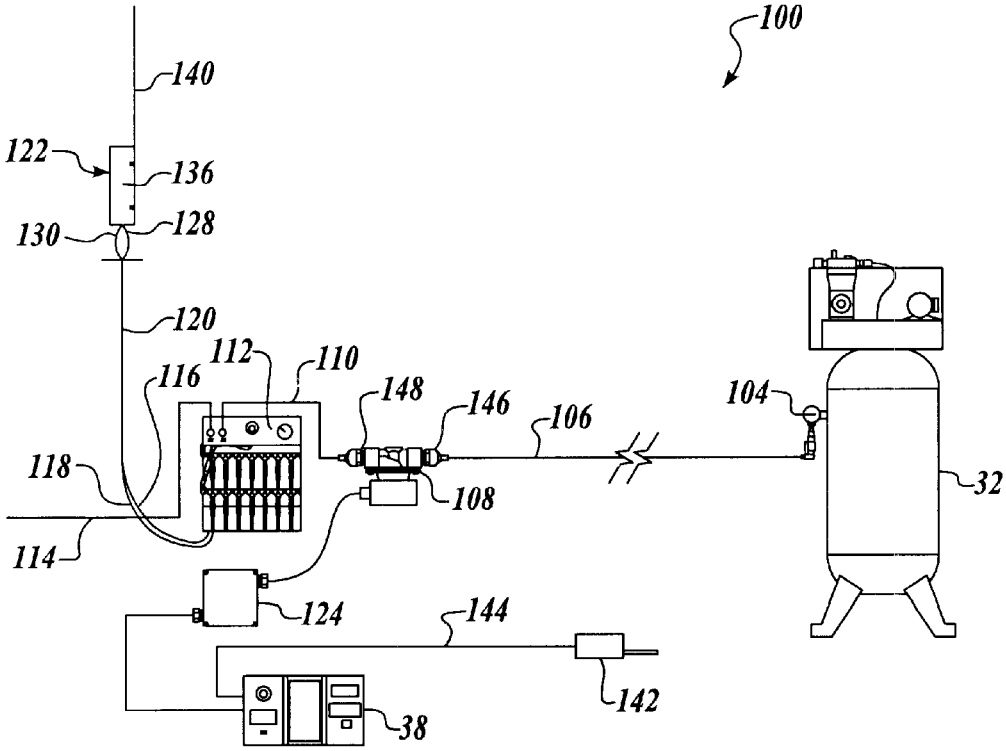
FIG. 2 illustrates a representative schematic of a humidification system for a storage facility incorporating the drawback valve and heated conduit assembly.

An additional embodiment of the present invention is shown in FIG. 2, which depicts an illustrative system 100 typically used in a storage facility. Reference numbers for components that are similar between the several embodiments are retained for clarity. System controller 38 is electrically connected to pneumatic solenoid valve 108 via an electrical communication means 124. Any suitable system controller or controllers may be employed in the present invention, but in especially preferred embodiments, humidity controller, model DZR-43 by Contronics (Ambachtsweg, The Netherlands) and/or model W351AB-2C by Johnson Controls, Inc. (Milwaukee, Wis.), which may be used in combination with humidity display, model D351AA-1C and/or power supply, model Y350R-1C of Johnson Controls, Inc. (Milwaukee, Wis.). A sensor 142 is in communication with system controller 38 through a sensor communication link 144. Sensor 142 may be of any conventional design and provide environmental feedback to said system controller for a variety of parameters, including humidity, temperature and the like. In preferred embodiments, sensor 142 is exemplified by humidity sensor HS-90 by Contronics (Ambachtsweg, The Netherlands) or humidity sensors F3V-W65 and/or F2C-W65 by Rotronic Instrument Corp. (Huntington, N.Y.), thereby providing humidity readings to system controller 38.

Compressed air supply 32 (actuated by a self-contained pressure switch), having a conventional compressor outlet assembly 104 connected with a primary air line 106, is connected by any suitable connecting means to an air inlet port 146 of a pneumatic solenoid valve assembly 108, or other similar valve assembly. It is understood that any of a variety of compressed air supply 32, such as air compressors of all types and sizes, may be employed with the various embodiments of the present invention, including electric, internal combustion, solar- and/or wind-powered, and the like. It is further understood that various system configurations well known in the art may be used in practicing the present invention. For example, electrical communication means 124 may connect directly to compressed air supply 32, thereby obviating the need for pneumatic solenoid valve assembly 108, or other similar valve assembly.

A secondary air line 110 exits from an air outlet port 148 of pneumatic solenoid valve assembly 108 and connects to a standard air and water distribution manifold assembly 112. An inlet water supply line 114 is connected by any conventional means to air and water distribution manifold assembly 112, whereby water is provided to humidification system 100. Manifold assemblies are well known in the art and any suitable configuration may be employed in the present invention. A plurality of manifold outlet air lines 116 and a plurality of manifold outlet water lines 118 exit from air and water distribution manifold assembly 112 to connect with a plurality of heated conduit assemblies 120. For simplicity, FIG. 2 shows one set of manifold outlet air and water lines 116, 118, respectively, and associated downstream components, but in application, a multitude of such components may be utilized.

Figure 5:
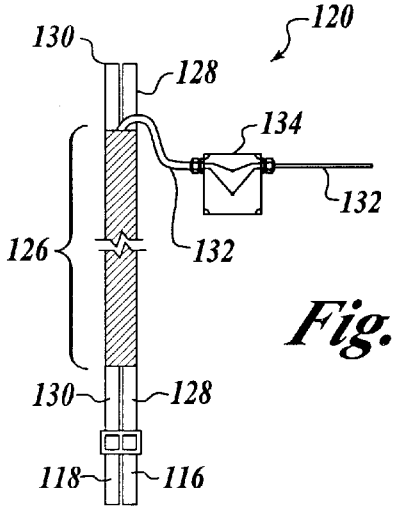
FIG. 5 is an enlarged perspective of the heated conduit assembly and associated components.

With reference to FIG. 5, the components are referred to in the singular form even though it is understood that a multitude of such components may be employed. A manifold outlet air line 116 and manifold outlet water line 118 are connected by any conventional means to a corresponding air conduit 128 and a water conduit 130 of heated conduit assembly 120, respectively. Air and water conduits 128, 130 respectively may be made of any suitable material and appropriate dimensions, including, but not limited to plastics, polymeric materials and metal. In especially preferred embodiments, polypropylene tubing of approximately 0.25 to 0.5 inch O.D. is utilized, mot preferably 0.25 inch having a pressure rating of 90 to 150 psi. Air and water conduits 128 and 130 are in close association with a conduit heating assembly 126. Conduit heating assembly 126 may be any suitable means, including, but not limited to electrical, mechanical and/or chemical. In preferred embodiments of the present invention, conduit heating assembly 126 is an electrical resistance tape wrapped around air and water conduits 128 and 130, such as provided by Clayborn Precision Heat Tape (Truckee, Calif.) providing approximately 3 to greater than 11 watts per foot. In especially preferred embodiments, conduit heating assembly 126 is electrical resistance tape having a rating of 11 watts per foot wound around 1 to greater than 10 feet of air and water conduits 128 and 130, most preferably around 10 feet. Electrical resistance tape of lower wattage rating may be utilized in the present invention, but may require a proportionately greater span along air and water conduits 128 and 130 to compensate for the lower heat input. Additionally, varying lengths of conduit heating assembly 126 may be employed depending upon the particular application requirements. Several variables should be taken into account to assure optimal performance, such as, but not limited to, overall ambient temperature requirements, localized temperature in the immediate vicinity of the atomization nozzle assemblies, which may be in the proximity of refrigeration works, and the like. Conduit heating assembly 126, i.e. electrical resistance tape, is electrically connected to a standard electrical cord and plug 132 via any conventional electrical connection means 134. Numerous conduit heating assemblies 126 may be wired together at electrical connection means 134 with a single electrical connection 132 to one outlet. In preferred embodiments, one to over 20 assemblies 126 may be wired together. Electric current passing through conduit heating assembly 126 encounters resistance whereby heat is generated and transferred to the contents of air and water conduits 128, 130, respectively. The heated conduit assembly of the present invention obviates the need to directly apply a heating means to atomization nozzle assemblies 28. As described in detail below, this heat source prevents water from freezing in air and water lines, as well as in the atomization nozzle assembly.

Figure 4:
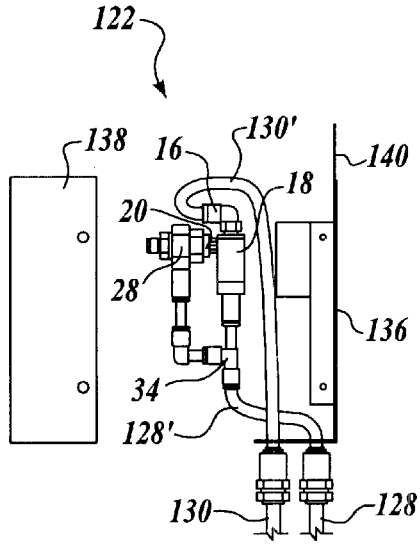
FIG. 4 is an enlarged perspective of one embodiment of the drawback valve in relation to associated components.

As illustrated in FIG. 4, the distal ends of air and water conduits 128, 130, respectively, connect through any conventional connecting means to an atomization assembly 122. Atomization assembly 122 may optionally be partially enclosed within a housing 136, having an access cover 138. For optimal performance, housing 136 containing atomization assembly 122 is preferably mounted in close association with existing refrigeration works 140. Atomization assembly 122 comprises a drawback valve 18, an atomization nozzle assembly 28 and associated air and water conduits 128', 130', respectively, and other various connecting means 34. Air and water conduits 128, 130, respectively, are connected in-line with complementary air and water conduits 128', 130', respectively, or alternatively, may be uninterrupted lines. Distal end of air conduit line 128' connects to multiport connecting means 34, thereby providing compressed air to drawback valve 18 and atomization nozzle assembly 28. Distal end of water conduit line 130' connects to water inlet port 16 of drawback valve 18, thereby providing pressurized water to drawback valve 18 and atomization nozzle assembly 28.

In operation, humidification system 100 is very similar to system 10, as previously described. System controller 38 receives input from sensor 142 concerning environmental conditions within the storage facility. In response to input from sensor 142, system controller 38 initiates a humidification cycle by sending a signal through electrical communication means 124 to open pneumatic solenoid valve 108. Solenoid valve 108 serves as a means for regulating the flow of compressed air to atomization assembly 122. Compressed air is provided to drawback valve 18 and atomization nozzle assembly 28 from compressed air supply 32 through the various lines and components located in between, as shown in FIG. 2.

As previously described, drawback valve 18 is controlled by air pressure, which in turn regulates the flow of pressurized water to atomization nozzle assembly 28. During a humidification cycle, compressed air is provided to drawback valve 18, causing an internal piston to be displaced. The displaced piston opens water inlet port 16 of drawback valve 18 allowing pressurized water to flow from water supply line 114 through air and water distribution manifold 112, manifold outlet water line 118 and water conduits 130 and 130'. Pressurized water flows from water conduit 130' through drawback valve 18 to water outlet 20 of drawback valve 18, which provides pressurized water to atomization nozzle assembly 28. Drawback valve 18 may be located at varying distances from atomization nozzle 28 assembly depending upon the particular application and set-up requirements, even though FIG. 4 shows the components in close association.

Figure 6:
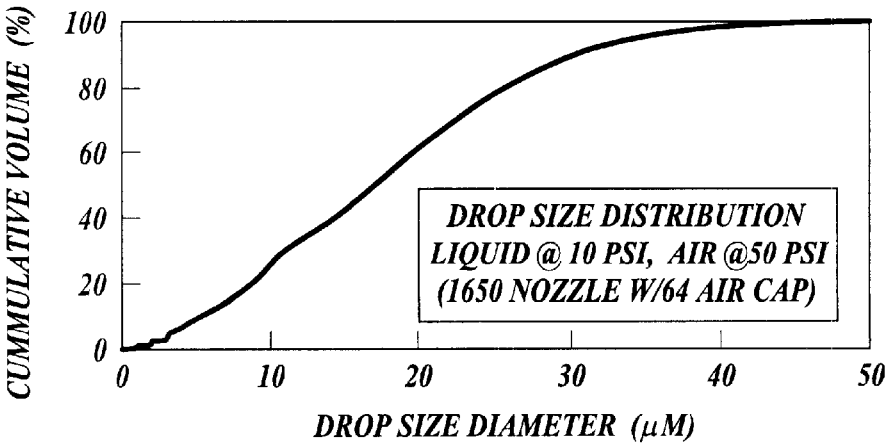
FIG. 6 illustrates the relationship between the water droplet diameter and the cumulative volume of water dispersed at a fixed air and water pressure using a select atomization nozzle assembly.

Compressed air and pressurized water are combined at the atomization assembly 28 and released into the atmosphere as a fine water vapor, as described above. Humidification systems for storage facilities may accept a wide variety of atomization nozzle assemblies, as described above for system 10. In addition, the dynamics between air and water pressure in combination with atomization nozzle assemblies determines the water droplet diameter and volume of water dispersed over time. Example 1 and FIG. 6 illustrate the relationship between the water droplet diameter and the cumulative volume of water dispersed at a fixed air and water pressure using the preferred 1650/64 atomization nozzle assembly.

At the end of the pressurization and atomization cycle, system controller 38 sends a signal via electrical communication means 124 shutting pneumatic solenoid valve 32, thereby reducing air pressure to drawback valve 18 causing drawback valve'internal piston to return to its original position, closing water inlet port 16. Displacement of the internal piston of drawback valve 18 to its original position generates negative water pressure in drawback valve 18 and water conduit 130'. Negative water pressure exerted by drawback valve 18 through water conduit 130' draws said water head in a retrograde direction back into water conduit 130' several inches and holds said water head in place until the next pressurization cycle.

As previously described, negative water pressure generated by drawback valve 18 effectively prevents water streaming from atomization nozzle assembly 28. Furthermore, residual air pressure in air conduit 128' fully atomizes any residual water atomization nozzle assembly 28, thereby displacing water that may stream or drip onto products below.

Atomization assembly 122 is typically located proximal to existing refrigeration works 140 in order to cool water vapor as it is emitted from atomization assemblies 28 into the atmosphere, which typically require ambient air temperatures around 34° F. Therefore, it is common for atomization nozzle assembly 28, drawback valve 18 and associated air and water conduits 128', 128 and 130', 130, respectively, to be exposed to temperatures ranging from 20–25° F. due to their proximity to refrigeration systems 140. As a result, the water in the aforementioned components has the tendency to freeze, thereby blocking air and water from reaching downstream components. To prevent freezing, heated conduit assembly 126 provides sufficient thermal energy to warm air and water conduits 128', 128 and 130', 130, respectively, drawback valve 18, atomization nozzle assembly 28 and associated fixtures, as well as the contents of those components.

The present invention reduces the time required to disperse atomized water into the atmosphere. In contrast to conventional systems, the present invention requires a only a small drop in air pressure sufficient to activate the drawback feature of drawback valve 18 thereby creating negative water pressure, which holds the water head 1–2 inches from the nozzle assembly. Upon activation of a pressurization and atomization cycle, the system is poised to disperse the atomized water immediately.

The humidification systems of the present invention, incorporating drawback valve 18 and, optionally, miniature water regulator 26 eliminates manually balancing the air to water pressure ratio for each particular application, as currently required in conventional systems. Drawback valves incorporated into humidification systems of the present invention, having an air pilot 2-way poppet design, automatically maintains a pressure differential of 10–12 psi air pressure over water pressure. As the water pressure varies, the drawback valve adjusts accordingly to maintain the necessary air pressure for proper atomization of water at the nozzle assembly. In contrast, conventional systems require manually adjusting the air and water pressure to achieve the desired ratio for delivering a desired volume of water vapor.

Setting the volume of water vapor released into the atmosphere is accomplished by adjusting the regulating means on miniature water regulator 26, or at a separate water pressure regulator.

Embodiments of the present invention are capable of operating at very high water pressure conditions without the use of traditional water regulators, solenoid valves and pressure tanks. The present invention incorporating a drawback valve, and optionally, a miniature water regulator, is capable of operating at water pressures greater than or equal to 80–100 psi, resulting in a greater volume of water vapor released into the atmosphere. This attribute is especially important in large applications, such as in walk-in coolers and in particular, large storage facilities, where the tremendous volume of air in the enclosed facility requires more water vapor to maintain a suitable relative humidity and temperature. Notably, even at these higher pressures, the current invention prevents streaming from the nozzle heads.

The efficiency and performance of the humidification system of the present invention may be enhanced by the incorporation of additional features and accessories associated with the system. For example, a water treatment or purification system may be integrated into the humidification system by connecting the purification system upstream of the drawback valve and water regulator. Many types of water purification systems are suitable. Reverse osmosis water purification systems are preferred. The water purification system removes undesirable minerals, particulates, and/or microbes that may adversely affect the function of the system, or adversely affect the quality of the food items.

Additionally, the performance of automated humidification systems of the present invention may be enhanced by integrating a means for distributing antimicrobial agents upstream of the atomization nozzle assemblies. The use of antimicrobial agents retards microbial incidence and proliferation in food product environments, thereby extending the life of perishable food products.

The present invention also provides kits for retrofitting existing humidification systems for the hydration of environments in which perishable products are displayed and/or stored. Kits of the present invention comprise one or more drawback valve(s), miniature water regulator(s) and/or heated conduit assembly(ies), as well as any accessory components required for efficient installation, such as, but not limited to atomization nozzle assemblies, air and water lines, conduits, fittings, connectors, electrical connectors, and the like.

In certain embodiments, a kit comprising one or more heated conduit assembly, drawback valve and/or atomization assembly, as well as necessary lines, conduits, fittings, connectors, electrical connectors, and the like may be pre-assembled, or alternatively, be packaged as separate components is provided. Optionally, the above kit may include one or more miniature water regulators, either pre-assembled with the other components or as a separate component.

In other embodiments, a kit comprising one or more atomization nozzle assembly(ies), drawback valve(s) and/or miniature water regulators, as well as necessary lines, conduits, fittings, connectors, electrical connectors, and the like may be pre-assembled, or alternatively, be packaged as separate components is provided.

In yet another embodiment, a kit comprising one or more drawback valve(s) and/or miniature water regulators, as well as necessary lines, conduits, fittings, connectors, electrical connectors, and the like may be pre-assembled, or alternatively, be packaged as separate components is provided.

In still yet another embodiment, a kit comprising one or more drawback valve(s), as well as necessary lines, conduits, fittings, connectors, electrical connectors, and the like may be pre-assembled, or alternatively, be packaged as separate components is provided.

Other kit embodiments may comprise one or more pre-assembled heated conduit assemblies and associated lines, conduits, fittings, connectors, electrical connectors and the like.

It is understood that the foregoing discussion only illustrates the invention and its principles. However, many modifications and variations in the details of the disclosure will occur to those skilled in the art to which this invention relates and still remain within the scope and principles of the invention. It will be understood that obvious variations and modifications thereof that may be made by those skilled in the art are intended to be included within the spirit and purview of this application and the scope of the appended claims.

EXAMPLES

Example 1

Drop Size Diameter in Relation to Cumulative Water Volume Dispersed

Studies were performed to determine the relationship between the percent cumulative volume of water dispersed and the water droplet diameter. A series 1650 atomization nozzle with a series 64 air cap were tested at a constant 10 psi water pressure and 50 psi air pressure were used in the inventive system. FIG. 6 is a graphical representation of the relationship between the percent cumulative volume of water dispersed and the water droplet diameter. The data shows a steady increase in the percent cumulative volume of water dispersed as the drop size diameter increases. Table I provides the values for FIG. 6, and further provides the percent of the droplet population at the respective diameter.

TABLE I

| DROP SIZE DIAMETER (μICRONS) | % CUMULATIVE VOLUME OF WATER | % OF DROPLET POPULATION |
|---|---|---|
| 1 | 0.24 | 0.01 |
| 1 | 0.34 | 29.77 |
| 1 | 0.52 | 56.62 |
| 1 | 0.78 | 69.38 |
| 2 | 1.19 | 81.59 |
| 2 | 1.82 | 85.68 |
| 3 | 2.75 | 90.57 |
| 3 | 4.18 | 94.56 |
| 4 | 6.31 | 97.33 |
| 5 | 9.49 | 98.59 |
| 7 | 14.17 | 99.23 |
| 9 | 20.88 | 99.41 |
| 11 | 30.23 | 99.53 |
| 15 | 42.65 | 99.64 |
| 19 | 57.99 | 99.72 |
| 24 | 74.93 | 99.79 |
| 31 | 90.81 | 99.85 |

TABLE I-continued

| DROP SIZE DIAMETER (μICRONS) | % CUMULATIVE VOLUME OF WATER | % OF DROPLET POPULATION |
|---|---|---|
| 40 | 98.29 | 99.95 |
| 51 | 99.89 | 100.00 |

Further statistical analysis of the mean diameters and distribution parameters of the water droplets generated under the above-described conditions yielded the values provided in Table II below.

TABLE II

| Parameter | microns |
|---|---|
| Arithmetic mean | 2 |
| Mean surface area | 3 |
| Mean volume | 4 |
| Surface - diameter mean | 4 |
| Evaporative mean | 6 |
| Saufer mean | 10 |
| Herdan mean | 18 |
| Volume median diameter | 16 |
| Number median diameter | 2 |

Humidification systems of the present invention provide a very fine water mist or vapor. A volume median diameter of 16 μm (as taken from Table II) is especially desirable. Water mist or vapor with droplets of this size circulate longer in the atmosphere and are less prone to precipitate onto perishable items below, or to condense onto surrounding fixtures and precipitate.

What is claimed is:

1. An automated humidification system comprising:

(a) At least one system controller;

(b) a compressed air supply providing compressed air to said automated humidification system, operably linked to said system controller, such that said system controller regulates said compressed air supply;

(c) a pressurized water supply;

(d) at least one drawback valve operably connected to said pressurized water supply and said compressed air supply; and (e) at least one atomization nozzle assembly operably connected to said drawback valve, such that said drawback valve generates negative water pressure within said atomization nozzle assembly at the termination of a pressurization and humidification cycle, thereby preventing water from streaming from said atomization nozzle assembly.

2. The automated humidification system according to claim 1, further comprising at least one miniature water regulator operably interposed between said pressurized water supply and said atomization nozzle assembly.

3. The automated humidification system according to claim 1, further comprising at least one heated conduit assembly operably interposed between said compressed air supply means, said pressurized water supply and said drawback valve such that said heated conduit assembly prevents ice formation in said atomization nozzle assembly, drawback valve assembly, pressurized water supply and compressed air supply, as well as said operable connections.

4. The automated humidification system according to claim 3, further comprising at least one miniature water regulator operably interposed between said pressurized water supply and said atomization nozzle assembly.

5. In an improved automated humidification system of the type having at least one system controller, a compressed air supply providing compressed air to said automated humidification system and operably linked to said system controller such that said system controller regulates said compressed air supply, a pressurized water supply providing a water source and at least one atomization nozzle assembly operably connected to said compressed air supply and said pressurized water supply, the improvement comprising:

(a) providing a drawback valve operably connected to said pressurized water supply and said compressed air supply such that said drawback valve generates negative water pressure within said atomization nozzle assembly at the termination of a pressurization and humidification cycle, thereby preventing water from dripping from said atomization nozzle assembly.

6. An improved automated humidification system according to claim 5, wherein the improvement further comprises at least one miniature water regulator operably interposed between said pressurized water supply and said atomization nozzle assembly.

7. An improved automated humidification system according to claim 5, wherein the improvement further comprises, providing at least one heated conduit assembly operably interposed between said compressed air supply, said pressurized water supply and said drawback valve, such that said heated conduit assembly prevents ice formation in said atomization nozzle assembly, drawback valve assembly, pressurized water supply and compressed air supply, as well as said operable connections.

8. An improved automated humidification system according to claim 7, wherein the improvement further comprises, providing at least one miniature water regulator operably interposed between said pressurized water supply and said atomization nozzle assembly.

9. A method for effectively humidifying an environment, comprising operating an automated humidification system according to claim 1.

10. A method for effectively humidifying an environment, comprising operating an automated humidification system according to claim 2.

11. A method for effectively humidifying an environment, comprising operating an automated humidification system according to claim 3.

12. A method for effectively humidifying an environment, comprising operating an automated humidification system according to claim 4.

13. A method for preventing streaming from an automated humidification system, comprising incorporating a drawback valve into an automated humidification system according to claim 1.

14. A method for preventing ice formation in an automated humidification system, comprising incorporating a heated conduit assembly into an automated humidification system according to claim 3.

* * * * *